United States Patent [19]

Cappel

[11] 4,198,111

[45] Apr. 15, 1980

[54] MEANS AND METHOD OF SECURING WELDING CABLE CONDUCTORS TO THEIR TERMINAL COMPONENTS

[75] Inventor: Glenn A. Cappel, Flat Rock, Mich.

[73] Assignee: Nu-Core, Inc., Romulus, Mich.

[21] Appl. No.: 910,273

[22] Filed: May 30, 1978

[51] Int. Cl.[2] ..... H01R 13/00

[52] U.S. Cl. ..... 339/112 L; 174/15 WF; 219/137.9; 339/15

[58] Field of Search ..... 174/15 WF, 19, 74 R; 219/137.9; 339/112 L, 112 R, 15

[56] References Cited

U.S. PATENT DOCUMENTS

| | | | |
|---|---|---|---|
| 3,333,044 | 7/1967 | Toto | 174/19 X |
| 3,363,047 | 1/1968 | Grove | 174/15 WF |

*Primary Examiner*—Roy Lake
*Assistant Examiner*—DeWalden W. Jones
*Attorney, Agent, or Firm*—Willis Bugbee

[57] ABSTRACT

Each welding cable terminal component, such as a semi-cylindrical terminal half, near its rearward end is provided with a semi-cylindrical recess in which the cable conductors are received and held in position by a clip in the form of an endless band having a partially cylindrical external portion snugly fitting a corresponding external semi-cylindrical groove in the terminal component. A chordal inner portion of the clip is pressed forcibly into compressing engagement with the ends of the cable conductors within the recess, whereupon molten solder is flowed into the recess under the clip between the hair-like wires of the strands of the cable conductors, thereby forcibly holding the cable conductors firmly in the recess while the solder permeates the entire cable conductor ends within the recess. The terminal components of which there are at least two, are then assembled with an insulating strip between them and clamped together, as by bolts. From each recess of each terminal component, a passageway runs forward to a transverse cooling water port to which connection is made to external cooling water hoses for cooling the cable during use. The forward ends of the terminal components together with the forward end of the insulating strip between them are provided with aligned transverse bores through which passes an insulated bolt for securing the rearward terminal to a welding current transformer and the forward terminal to a welding gun or machine.

1 Claim, 7 Drawing Figures

FIG. 1
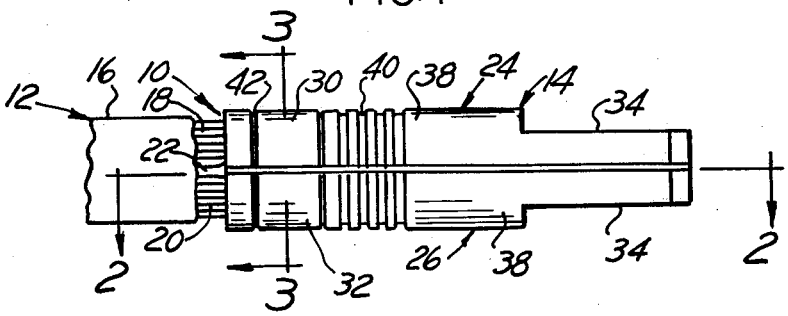
FIG. 2
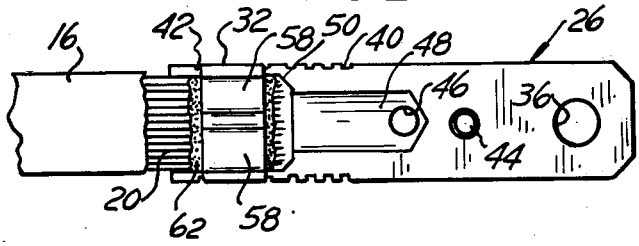
FIG. 3
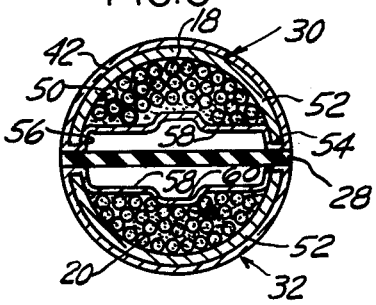
FIG. 4
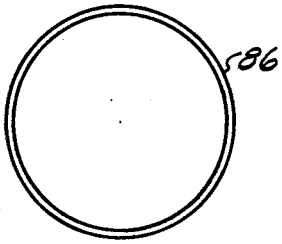
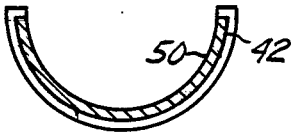
FIG. 5
FIG. 6
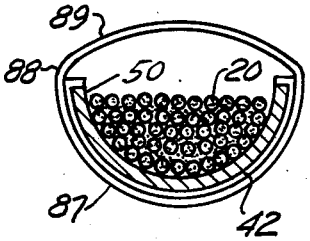
FIG. 7
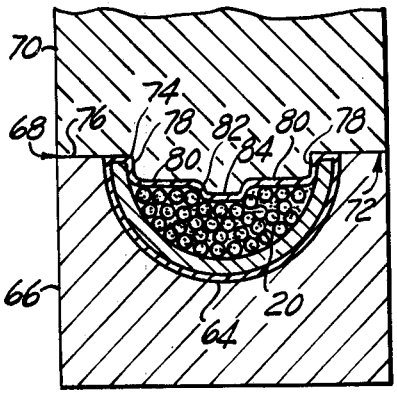

MEANS AND METHOD OF SECURING WELDING CABLE CONDUCTORS TO THEIR TERMINAL COMPONENTS

BACKGROUND OF THE INVENTION

Welding cable conductors have hitherto been secured to the respective components of their terminals at their opposite ends by having their cable conductors soldered in recesses at the rearward ends of the terminal components. Since each cable conductor is made up of so-called cable ropes which in turn are made up of a multiplicity of twisted strands of copper, each of which is composed of many hair-like copper wires, the holding of such a conductor end within its respective recess at the rearward end of the terminal component is attended with difficulty during soldering. Even when well done, the soldering of the conductor end within the recess often causes the conductor to fill an undesirably large proportion of the recess because of the expansion of the wire strands and ropes during soldering, so that the remainder of the space left for the passage of the cooling water is undesirably constricted.

SUMMARY OF THE INVENTION

The invention particularly resides in the provision of the cable conductor end-holding clip with its semi-cylindrical outer portion installed in a corresponding semi-cylindrical outer groove in the terminal component and with its inner portion forcibly deformed by being pressed against the cable conductor end in its respective terminal component recess prior to soldering the conductor end to the terminal component within that recess. This clip permits unrestricted cooling water flow through the terminal and consequently enhances water cooling of the cable itself during use. The use of this clip also serves to hold the hair-like wires of the strands composing the cable conductor end in the terminal recess during soldering. Moreover, should the soft solder melt due to a reduction or failure of cooling water with consequent over-heating of the terminal, the clips still secure the cable conductors to their respective terminal components. The use of this clip further aids in maintaining a low cooling water pressure drop through the cable which results in producing the maximum cooling efficiency of the cable during use.

In the drawing,

FIG. 1 is a side elevation of one end of a welding cable assembly including a welding cable terminal with the end of the cable hose and terminal broken away and with the ends of the cable conductors secured in their respective recesses of their terminal components by clips and solder, according to the present invention;

FIG. 2 is a central horizontal section taken along the line 2—2 in FIG. 1, similarly broken away and showing the lower terminal component and its respective cable conductor end secured in the terminal component recess with the aid of the clip according to the present invention;

FIG. 3 is a cross-section through the cable terminal and adjacent cable portion taken along the line 3—3 in FIG. 1;

FIG. 4 is an end elevation of the initial cable conductor-securing clip blank prior to its deformation and subsequent application to the cable conductor end within the recess in the terminal component;

FIG. 5 is a cross-section through the welding cable terminal component of FIG. 2 prior to installing the clip and cable conductor end;

FIG. 6 is an end elevation of the initial cable-securing clip blank after being deformed into an elongated oval intermediate clip blank and slid onto the rearward end of the cable terminal component with the cable conductor end disposed therein prior to further clip deformation and soldering; and FIG. 7 is a section similar to FIG. 6 but with the clip compressed and further deformed between mating dies to compress the hair-like wires of the cable conductor strand prior to soldering.

Referring to the drawing in detail, FIG. 1 shows a welding cable assembly, generally designated 10, as consisting generally of a welding cable 12 from which has been omitted the conventional welding cable casing or "hose" to expose the underlying construction. To this is attached a welding cable terminal 14 in a manner according to the invention as described below. The welding cable 12 itself is conventional and for the purpose of the present invention is believed to be sufficiently described as consisting generally of an internal welding cable assembly 16 including a pair of welding cable conductors 18 and 20 of opposing polarities separated from one another by an insulating member or separator 22. Each welding cable conductor 18 or 20 is made up of twisted strands of hair-like wires, these strands being formed into "ropes" which in turn are formed into said conductors of approximately semi-cylindrical cross-section, as is well known to those skilled in this art.

The welding cable terminal consists generally of terminal components 24 and 26 likewise of opposite polarities separated from one another by an elongated terminal insulating strip or plate 28 preferably having an interlocking end connection with the cable insulating member or barrier 22. The terminal components 24 and 26 near their rearward ends are grooved to receive conductor-gripping clips 30 and 32 respectively. The terminal components 24 and 26 are of identical but opposite construction, hence a single description is believed to suffice for both terminal components 24 and 26 at both of the opposite ends of the welding cable 12. Accordingly, the terminal component 26 will be given a description which, it will be understood, will suffice for the terminal component 24. Moreover, the lower half assembly of the welding cable conductor 20 and the terminal component 26 shown in FIG. 2 is identical with that of the upper half assembly of the welding cable conductor 18 and the terminal component 24.

Either terminal component 24 or 26 (FIG. 2) consists of an elongated approximately semi-cylindrical copper casting, the forward end of which is rabbetted to create a flat surface 34 which in turn is provided with a transverse hole 36 to receive the insulated bolt (not shown) by which the terminal 14 is connected to the welding transformer or welding gun (not shown) as the case may be. The outer semi-cylindrical rearward surface 38 is provided with multiple spaced narrow grooves 40 (FIG. 1) into which the forward end of the cable hose (not shown) is pressed by conventional hose clamps (not shown) which prevent leakage of the cooling water from between the hose and the terminal 14. In a location still further rearward of the narrow grooves 40 is a single broad semi-cylindrical groove 42 adapted to receive the clip 30 or 32 as described more fully below.

Each terminal component 24 or 26 (FIG. 2) contains a screw hole 44 which in the lower component 26 is threaded and in the upper component 24 is smooth (not shown) to receive a screw (also not shown) by which the two terminal components 24 and 26 are held together with the insulating clip 28 between them. Each insulating strip 28 is likewise drilled in alignment for the passage of the screw. Each insulating strip 28 also has a through hole (not shown) in it aligned with the holes 46 in order to permit free interflow therethrough of the cooling water along opposite sides of the insulating strip 28 and cable conductor insulating separator 22 joined end-to-end therewith.

Each terminal component 24 or 26 midway between its opposite ends is provided with a threaded hole 46 (FIG. 2) adapted to be connected to a conventional tubular fitting (not shown) for a cooling water hose by which cooling water is supplied to or discharged from the particular cable terminal component 24 or 26, depending on whether the composite terminal 14 thereof is intended to be connected to a cooling water supply hose or discharge hose, according to the installation. Each transverse threaded hole 46 at its inner end opens into a forward semi-cylindrical recess 48 which at its rearward end opens into a larger rearward semi-cylindrical recess 50.

Each clip 30 or 32 (FIGS. 2 and 3) in its installed form consists of an endless band having an outer semi-cylindrical portion 52 connected by a short radial portion 54 to a short tangential portion 56, the latter in turn being connected by an outer chordal portion 58 to an inner chordal portion 60. The portions 58 and 60 are formed during assembly in a manner set forth below and compress the strands of the welding cable conductor ends 18 or 20 yet enable solder 62 in a molten condition to penetrate the interstices between the hair-like wires of the conductors 18 or 20.

In assembling the welding cable 10 a lower die 66 containing an elongated semi-cylindrical cavity 64 (FIG. 7) is placed in a suitable press (not shown). The press is conventional and its details are beyond the scope of the present invention. It is believed sufficient to state that an upper die or punch 70 of a die set 72 including the lower die 66 and mating with it has a nose portion 74 with a pair of outer diametral portions 76 joined by tangential outer portions 78 to chordal inner portions 80 which in turn are joined by tangential portions 82 to a central chordal portion 84, the said upper die portions 76 to 84 conforming to the configuration to be imparted to the inner half of each clip comprising the portions 54 to 60 thereof.

With the end of the welding cable conductor 18 or 20 placed in the rearward recess 50 of the terminal component 24 or 26, a short hollow cylindrical initial clip blank 86 (FIG. 4) is bent by dies into the final clip blank 88 with differently-curved halves 87 and 89 (FIG. 6). The blank 88 is then slipped over the forward end of the terminal component 24 or 26 and slid rearwardly until it arrives immediately outside the semi-cylindrical groove 42 in the terminal component 24 or 26 to form an assembly 91. With the upper die or punch 70 of the press raised to expose the semi-cylindrical die cavity 64 in the lower die 66, the assembly 91 is transferred to the die cavity 64 in the recess 68. The upper die or punch 70 of the die set 72 is then caused to descend upon the above-mentioned assembly in the die cavity 64 by operating the press 68, whereupon the upper portion of the initial clip blank 88 is bent into the above-described shape shown in the central portion of FIGS. 2 and 3, the cable conductor end 18 or 20 being simultaneously compressed into a corresponding shape shown in FIG. 3. At the same time, the outer semi-cylindrical portion 52 of the clip 30 or 32 is firmly seated in its respective semi-cylindrical groove 42, while being simultaneously stretched across the bottom of the groove 42. This assembly, having assumed the shape shown in the lower part of FIG. 7 is then removed from the die cavity 64 thereof after the upper die or punch 70 of the die set 72 has been raised by raising the platen (not shown) of the press to permit such removal. Molten solder is then flowed into the shallow cavity occupied by the inner portion of the clip 30 or 32, penetrating the interstices between the hair-like wires and strands of the end of the welding cable conductor 18 or 20, as the case may be.

The procedure just described is repeated for the exposed ends of the conductors 18 and 20 for the other terminal component 24 and also for those at the opposite end of the welding cable 12 to secure these cable conductor ends to their respective terminal components 24 and 26. The components 24 and 26 of the terminal 14 at the opposite ends of the welding cable 12 are then brought together, with the insulating strip or plate 28 between them. and bolted together by a bolt or screw through the aligned holes 44 (FIG. 2). A conventional welding cable casing or hose (not shown) is then drawn over the entire cable 16 from one end of the welding cable assembly 10 until its opposite ends project over the multiple grooves 40. Conventional cable clamps (not shown) are then applied to the exterior of the hose at its opposite ends immediately outside the grooves 40 in order to clamp the opposite ends of the hose in a water-tight connection against the cable terminals 14 at the opposite ends of the cable 16. The cable is then ready for use.

I claim:

1. A welding cable terminal component adapted to be secured to one end of a rope-like multiple-wire welding cable conductor, said terminal comprising an elongated terminal component body having a forward portion adapted to be connected to a welding apparatus and a rearward portion adapted to be secured to the welding cable conductor, said terminal component body having a partly cylindrical outer side with a partly cylindrical peripheral groove therearound, said terminal component body having a substantially flat inner side with a longitudinal cooling liquid channel therein and having in said rearward portion a recess configured to receive the end of the welding cable conductor and communicating at its opposite ends with the opposite ends of said groove, and a welding cable conductor clamping grip comprising an endless band extending completely around said rearward body portion and having a partly cylindrical outer peripheral portion configured to fit said groove in mating relationship therewith, said clip having an inner approximately chordal portion extending across said recess and adapted to be deformed into compressing engagement with the end of the welding cable conductor disposed in said recess, said peripheral groove having substantially the same width as said clip and defining a cooling liquid passageway communicating with said channel.

* * * * *